US007651193B2

(12) United States Patent
Kawamoto et al.

(10) Patent No.: US 7,651,193 B2
(45) Date of Patent: Jan. 26, 2010

(54) INK JET RECORDING APPARATUS

(75) Inventors: Chiaki Kawamoto, Shizuoka (JP); Chikashi Ohishi, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 215 days.

(21) Appl. No.: 11/263,919

(22) Filed: Nov. 2, 2005

(65) Prior Publication Data

US 2006/0092212 A1 May 4, 2006

(30) Foreign Application Priority Data

Nov. 2, 2004 (JP) ..... 2004-318782
Mar. 16, 2005 (JP) ..... 2005-074579

(51) Int. Cl.
*B41J 2/15* (2006.01)

(52) U.S. Cl. ..... 347/22; 347/21; 347/28

(58) Field of Classification Search ..... 347/22–36, 347/65–69, 21
See application file for complete search history.

(56) References Cited

U.S. PATENT DOCUMENTS 6,164,760 A * 12/2000 Mizoguchi et al. ..... 347/55
6,513,910 B2 * 2/2003 Naniwa et al. ..... 347/55
2002/0001497 A1 1/2002 Naniwa et al.

FOREIGN PATENT DOCUMENTS

JP 2002-1989 A 1/2002
JP 3286209 B 3/2002

* cited by examiner

*Primary Examiner*—Manish S Shah
(74) *Attorney, Agent, or Firm*—Sughrue Mion, PLLC

(57) ABSTRACT

The ink jet recording apparatus includes an ejection head for ejecting ink droplets toward a recording medium by exerting electrostatic force onto ink containing charged colorant particles, an ink tank for reserving the ink to be supplied to the ejection head, a circulation path for circulating the ink between the ejection head and the ink tank, and a cleaning mechanism for cleaning the ejection head and the circulation path using cleaning liquid. The cleaning liquid circulated through the circulation path at a time of cleaning by the cleaning mechanism is obtained by adding a charge control agent to an ink dispersion medium.

6 Claims, 5 Drawing Sheets

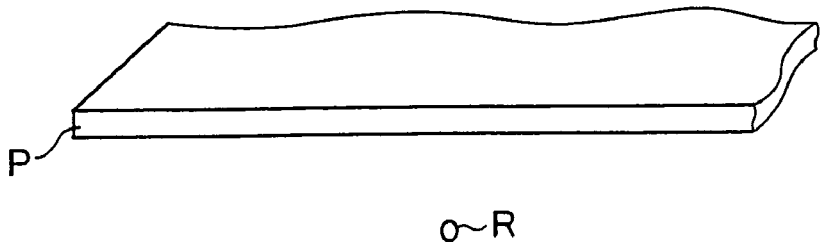
FIG. 3A
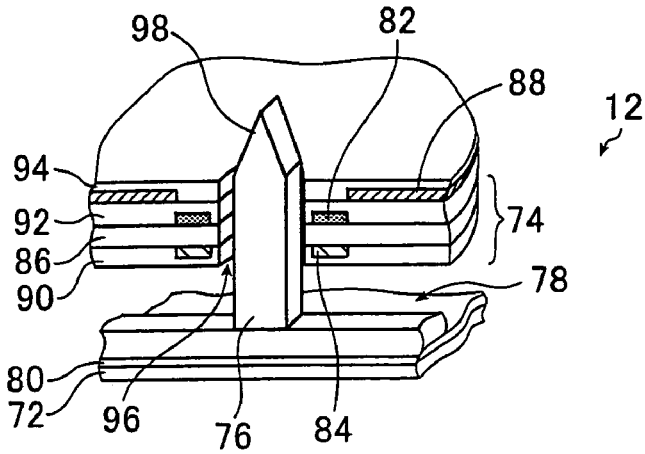
FIG. 3B
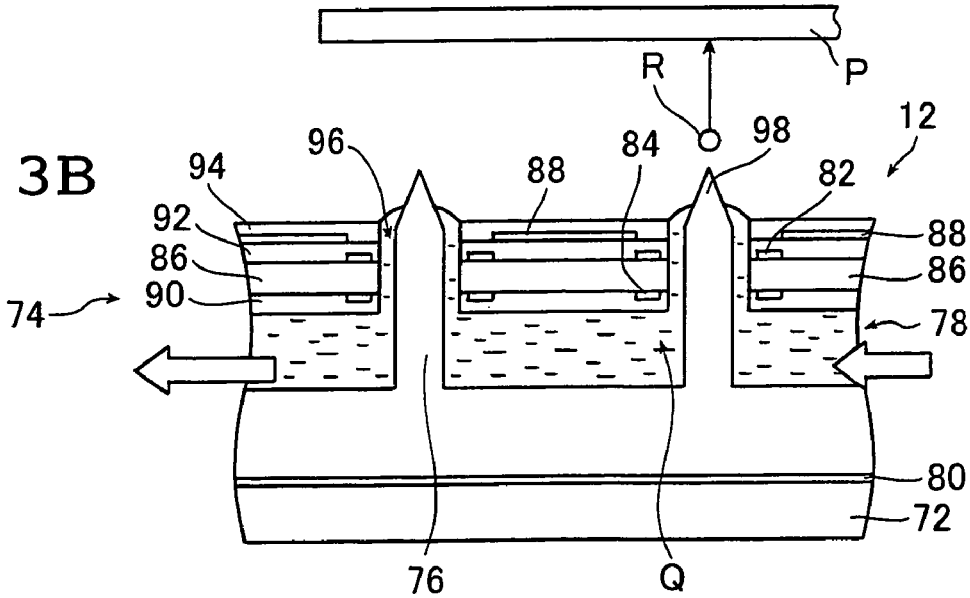

INK JET RECORDING APPARATUS

The entire contents of literatures cited in this specification are incorporated herein by reference.

BACKGROUND OF THE INVENTION

The present invention relates to an ink jet recording apparatus including an ejection head for ejecting ink. More specifically, the present invention relates to an ink jet recording apparatus including a cleaning system for cleaning an ejection head.

There has been known an electrostatic ink jet recording apparatus in which ink obtained by dispersing fine particles containing colorants in a carrier liquid is ejected as ink droplets through exertion of electrostatic forces onto the ink, to thereby perform drawing (image recording). In addition, as one type of the electrostatic ink jet recording apparatus, there has also been known an electrostatic concentrated ink jet recording apparatus which uses ink obtained by dispersing charged particles containing colorants in a carrier liquid, causes the colorant particles to move to ejection portions (nozzles) through migration by means of electrostatic forces or the like, and ejects ink droplets under a state where the ink is concentrated.

In the electrostatic ink jet recording apparatus, ordinarily, the ink is circulated through a predetermined ink circulation system including a main ink tank (main tank) for reserving the ink and an ejection head, to thereby supply the ink to the ejection head to perform drawing.

In an ink jet recording apparatus in which ink is circulated and is supplied to an ejection head, which is not limited to the above-mentioned electrostatic ink jet recording apparatus, when the apparatus is left under a state where the ink circulation is stopped and the ink (the carrier liquid) is evaporated, there may occur a problem in that the ink is dried in ejection ports (nozzles) and in the ink circulation system to adhere thereto, which leads to clogging, a circulation failure, or the like.

In order to solve the problem inherent to the ink jet recording apparatus, various techniques are proposed.

In JP 2002-1989 A, for instance, there is disclosed an ink jet printer including an ink circulation system and a cleaning liquid circulation system, in which a three-way solenoid valve is provided on an ejection nozzle side to alternately supply ink and a cleaning liquid, and a three-way solenoid valve is provided on a side for capturing unnecessary particles with a gutter to separately recover the ink and the cleaning liquid, where a cleaning-side solenoid of the three-way solenoid valve on the recovery side is delayed to drive upon a switching instruction to the three-way solenoid valve on the supply side to thereby prevent a cleaning waste liquid from being mixed into an ink tank.

Also, JP 3286209 B discloses an ink jet recording apparatus that leads ink and a solvent held in an ink container and a solvent container provided in an apparatus main body into a print head through an ink jet tube and a solvent tube respectively, and performs printing and cleaning by selectively supplying the ink and the solvent to each nozzle using a control valve provided in the print head, where an ink chamber located inside an ink jet port of the nozzle is connected to an ink container in the apparatus main body through a circulation tube to form a circulation passage, and the solvent is supplied to the ink chamber of the nozzle by operating the control valve for cleaning, to let a part of the solvent in the ink chamber flow through the circulation path by causing the ink in the ink chamber to jet from the ink jet port.

Here, with consideration given to contamination of the ink, the dispersion medium of the ink has conventionally been used as the cleaning liquid for the cleaning. However, a solvent used in the dispersion medium has a high intrinsic resistance value, which causes an insulating material (resin or rubber-made tube) in the circulation path to be charged through friction with the cleaning liquid when the cleaning liquid is circulated. When the circulation path is charged through the cleaning liquid circulation in the manner described above, this leads to a problem in that a charge amount of the ink circulated through the circulation path changes after the cleaning as compared with that before the cleaning.

In particular, in the case of the electrostatic ink jet recording apparatus that performs ink ejection by exerting electrostatic forces onto the ink, the unstable charge amount ink leads to a problem in that the ejection characteristics of the ink jet head fluctuate and image reproducibility is deteriorated.

A method for preventing the circulation path from being charged includes a method in which a conductive tube is used as the piping of the circulation path. However, the cost of the conductive tube is twice as high as that of a Teflon (registered trademark) PFA tube, which leads to a problem in that the cost of the apparatus is inevitably increased.

Alternatively, for preventing the circulation path from being charged, it is also possible to use a method in which metallic piping is adopted for every piping of the circulation path, however, in the case of using a head of head scanning type or the like, or in a case where the circulation path is not fixed, the piping needs to be flexible and therefore it is impossible to use the metallic piping.

SUMMARY OF THE INVENTION

The present invention has been made to solve the problems described above and has an object to provide an ink jet recording apparatus which is possible to prevent charging of a circulation path due to cleaning at low cost, and is possible to be adapted to various forms.

In order to attain the object described above, the present invention provides an ink jet recording apparatus for ejecting ink droplets toward a recording medium by exerting electrostatic force onto ink containing charged colorant particles, comprising an ejection head for ejecting the ink droplets by exerting the electrostatic force onto the ink containing the charged colorant particles, an ink tank for reserving the ink to be supplied to the ejection head, a circulation path for circulating the ink between the ejection head and the ink tank, and a cleaning mechanism for cleaning the ejection head and the circulation path using cleaning liquid, wherein the cleaning liquid circulated through the circulation path at a time of cleaning by the cleaning mechanism is obtained by adding a charge control agent to an ink dispersion medium.

Preferably, electric conductivity of the cleaning liquid is 30% or more of the electric conductivity of the ink.

Preferably, electric conductivity of the cleaning liquid is 70% or more of the electric conductivity of the ink.

Preferably, the cleaning mechanism comprises a cleaning liquid tank for reserving the cleaning liquid, and a charge control agent tank connected to the cleaning liquid tank for supplying the charge control agent to the cleaning liquid tank.

According to the present invention, a liquid obtained by adding a charge control agent to an ink dispersion medium is used as a cleaning liquid. Accordingly, it becomes possible to prevent frictional charging of a circulation path from being caused by cleaning, to thereby stabilize, without fluctuating, the electric conductivity of ink supplied to the circulation after the cleaning. As a result, it becomes possible to stabilize ink ejection at the time of image recording and form an image having high image reproducibility.

BRIEF DESCRIPTION OF THE DRAWINGS

In the accompanying drawings:

FIGS. 3A and 3B are each a conceptual diagram of an ejection head of the ink jet recording apparatus shown in FIG. 1, in which FIG. 3A is a partial cross-sectional perspective view and FIG. 3B is a cross-sectional view;

DETAILED DESCRIPTION OF THE PREFERRED EMBODIMENTS

Hereinafter, an ink jet recording apparatus according to the present invention will be described in detail based on preferred embodiments illustrated in the accompanying drawings.

Figure 1:
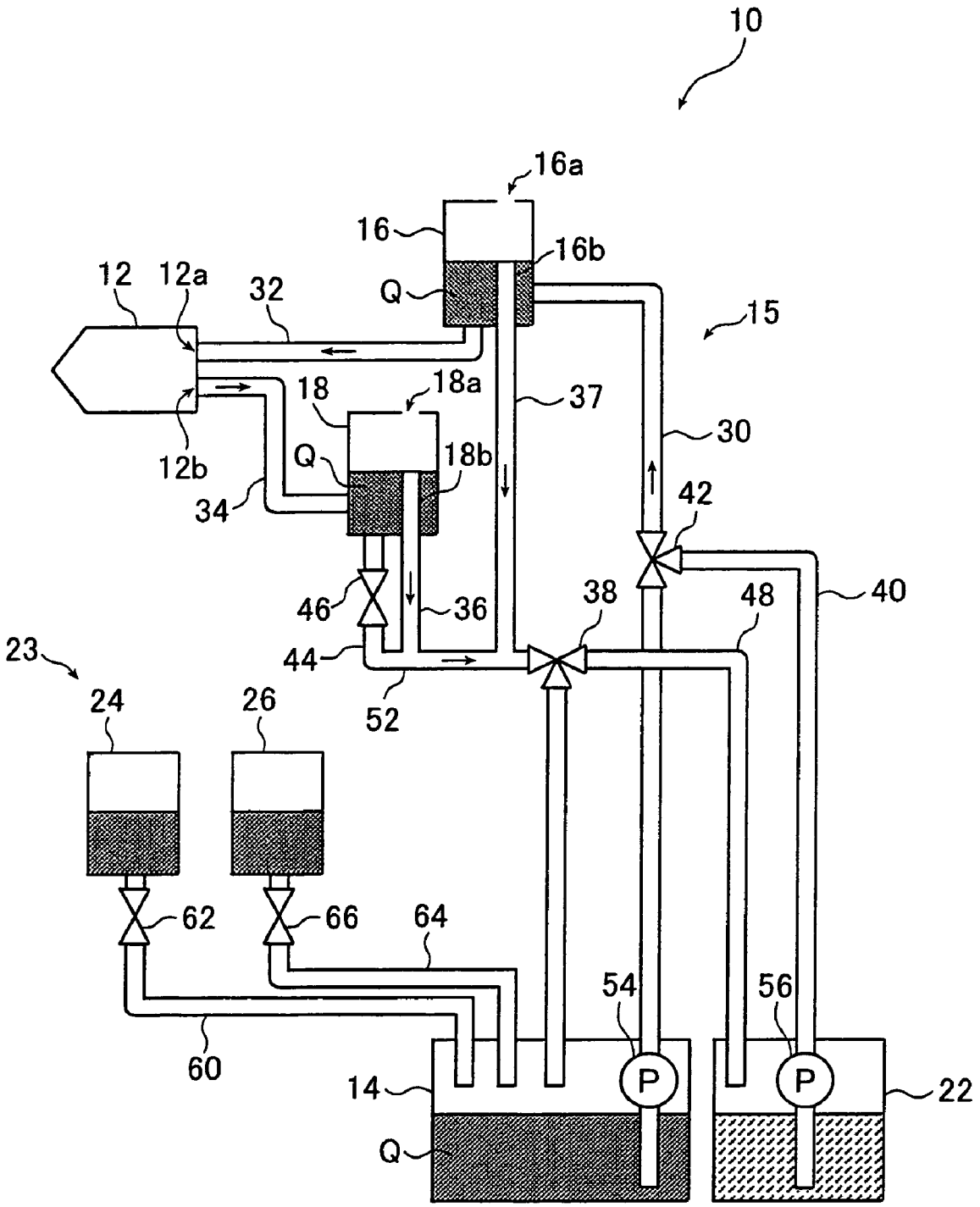
FIG. 1 is a conceptual diagram of one embodiment of a construction of an ink circulation system of the ink jet recording apparatus according to the present invention.

FIG. 1 shows a conceptual diagram of one embodiment of a construction of an ink circulation system of the ink jet recording apparatus according to the present invention.

An ink jet recording apparatus (hereinafter referred to as the "recording apparatus") 10 shown in FIG. 1 is an electrostatic ink jet recording apparatus that uses ink Q obtained by dispersing charged fine particles containing colorants (hereinafter referred to as the "colorant particles") in an insulating carrier liquid (dispersion medium) and ejects ink droplets by exerting electrostatic forces onto the ink. As shown in FIG. 1, the recording apparatus 10 basically includes an ejection head (ink jet recording head) 12, a main tank 14, an ink circulation path 15, a cleaning liquid tank 22, and any ink replenishment portion 23.

The ink circulation path 15 of the recording apparatus 10 mainly includes an ink supply system for supplying the ink Q in the main tank 14 to the ejection head 12 and an ink recovery system for recovering the ink Q which was not ejected from the ejection head 12. The ink supply system mainly includes an ink circulation pump 54 arranged in the main tank 14, a supply sub-tank 16, a first supply flow path 30 for connecting the ink circulation pump 54 and the supply sub-tank 16 to each other, a second supply flow path 32 for connecting the supply sub-tank 16 and an ink inflow port 12*a* of the ejection head 12 to each other, and a third recovery flow path 37 for recovering the ink Q overflowed into an overflow pipe 16*b* in the supply sub-tank 16. On the other hand, the ink recovery system mainly includes a recovery sub-tank 18, a first recovery flow path 34 for connecting an ink discharge port 12*b* of the ejection head 12 and the recovery sub-tank 18 to each other, a second recovery flow path 36 for recovering the ink overflowed into an overflow pipe 18*b* in the recovery sub-tank 18, and a common recovery flow path 52 connected to the main tank 14. It is possible to construct the supply flow paths and the recovery flow paths using, for example, pipes, or flexible tubes.

In FIG. 1, the cleaning liquid tank 22 is connected to the first supply flow path 30 through a cleaning liquid supply flow path 40, and a switching valve 42 is provided in a connecting portion between the cleaning liquid supply flow path 40 and the first supply flow path 30. The switching valve 42 is capable of changing a flow of a liquid so that the ink in the main tank 14 and the cleaning liquid in the cleaning liquid tank 22 are alternately supplied to be fed to the supply sub-tank 16. Also, the cleaning liquid supply flow path 40 is connected to a cleaning liquid circulation pump 56 arranged in the cleaning liquid tank 22.

Also, a drainage flow path 44 is connected to a bottom surface of the recovery sub-tank 18 in one end portion, and the other end portion of the drainage flow path 44 is connected to the common recovery flow path 52. Midway through the drainage flow path 44, an open/close valve 46 is provided.

Further, a switching valve 38 is provided on the common recovery flow path 52 and is also connected to a cleaning liquid recovery flow path 48 connected to the cleaning liquid tank 22. The switching valve 38 is capable of changing a flow of a liquid sent out from the second recovery flow path 36, the third recovery flow path 37, and the drainage flow path 44 to the common recovery flow path 52 so that the liquid is sent out to one of the main tank 14 and the cleaning liquid tank 22.

It should be noted that FIG. 1 shows one embodiment of the construction of the ink circulation system as described above and, as a matter of course, in addition to the ink circulation system shown in FIG. 1, the recording apparatus 10 according to the present invention includes various construction elements possessed by known electrostatic ink jet recording apparatuses such as a driver for driving the ejection head 12 to eject the ink droplets, scanning/conveying means for conveying (scanning and conveying) a recording medium P in a direction orthogonal to a nozzle line direction (row direction) to be described later through a predetermined path opposing the ejection head 12, charging means (or a counter electrode opposing to control electrodes of the ejection head 12) for applying a predetermined bias voltage to the recording medium P prior to image recording by the ejection head 12, electrostatic elimination means for performing electrostatic elimination to the charged recording medium P, conveying means for conveying the recording medium P through a predetermined path, a sensor for detecting the conveyed recording medium P, and solvent discharging means for discharging a carrier liquid remaining in the apparatus.

Also, the ink jet recording apparatus according to the present invention may be a monochrome recording apparatus for performing monochrome image recording using only K (black) ink or the like, or may be a recording apparatus for drawing full-color images on a recording medium using ink in four colors of Y (yellow), M (magenta), C (cyan), and K.

Further, the ejection head is not limited to the electrostatic ink jet head and various types of other ink jet heads may be used such as a thermal ink jet head and a so-called piezo-type ink jet head for ejecting ink by vibrating a diaphragm in an ink chamber using a piezo element, a micromachine or the like. However, it is particularly preferable that the recording apparatus according to the present invention use the electrostatic ink jet head among the various ink jet heads.

Still further, the recording apparatus 10 shown in FIG. 1 is a static-pressure ink jet recording apparatus including the ink circulation path 15 constructed by the main tank 14, the supply sub-tank 16, the recovery sub-tank 18, and the respective flow paths connecting the tanks to one another, and supplies the ink Q to the ejection head 12 by circulating the ink Q through the ink circulation path 15. However, the present invention is not limited to the static-pressure ink jet recording apparatus and is also applicable to, for instance, an ink jet recording apparatus including a pump-type ink circulation system that has an ink reservoir for reserving ink in an ejection head and circulates the ink by directly supplying the ink to the ink reservoir using a pump or the like.

The main tank 14 is an enclosed ink tank for mainly reserving the ink circulating through the ink circulation path 15 of the recording apparatus 10. It is preferable that the main tank 14 include agitating means for preventing settlement/accumulation of the colorant particles and temperature adjusting means for improving stability of ink ejection.

In the main tank 14, the ink circulation pump 54 for feeding the ink Q to the supply sub-tank 16 through the first supply flow path 30 is arranged. The amount of the ink Q fed by the ink circulation pump 54 is set to be larger than the amount of the ink Q supplied from the supply sub-tank 16 to the ejection head 12.

As shown in FIG. 1, the first supply flow path 30 and the second supply flow path 32 are connected to the supply sub-tank 16, and the supply sub-tank 16 is arranged higher than the ejection head 12 in a vertical direction. In the top surface of the supply sub-tank 16, a communication port 16*a* for communication with the atmosphere is formed, through which the inside of the supply sub-tank 16 is placed under an atmospheric-pressure environment. The second supply flow path 32 is connected to the supply sub-tank 16 at one end, and the other end thereof is connected to the ink inflow port 12*a* of the ejection head 12.

The ink Q supplied from the main tank 14 through the first supply flow path 30 is reserved in the supply sub-tank 16 and the reserved ink Q is supplied to the ejection head 12 through the second supply flow path 32.

Also, the overflow pipe 16*b* connected to the third recovery flow path 37 is arranged in the supply sub-tank 16, and the second supply flow path 32 is connected to the supply sub-tank 16 at the position lower than the top end of the overflow pipe 16*b*. In the illustrated embodiment, a construction is shown in which a connecting portion for the second supply flow path 32 is formed in the bottom surface of the supply sub-tank 16.

The ink reserved in the supply sub-tank 16 is supplied to the ejection head 12 through the second supply flow path 32 as a result of a gravity drop due to a water head pressure (pressure head) generated by a difference of altitude between an ink liquid surface in the supply sub-tank 16 and an ink liquid surface in the recovery sub-tank 18, and is further reserved in the recovery sub-tank 18 through the first recovery path 34. Accordingly, the flow amount of the ink supplied to the ejection head 12 is determined by the pressure head based on the ink liquid surfaces in the two sub-tanks, i.e., the supply sub-tank 16 and the recovery sub-tank 18 connected to the ejection head 12, and the internal pressure of the ejection head (height of meniscuses) is determined by the height of the ejection head positioned between the sub-tanks.

Also, when the ink supplied by the ink circulation pump 54 exceeds the height of the overflow pipe 16*b* in the supply sub-tank 16, it is discharged through the overflow pipe 16*b*, so the height of the liquid surface in the tank 16 is kept constant. As a result, the supply amount and supply pressure (pressure head) of the ink Q from the supply sub-tank 16 to the ejection head 12 are kept constant and ink supply in a so-called static-pressure system is performed.

It should be noted that the ink Q discharged through the overflow pipe 16*b* is returned to the main tank 14 through the third recovery flow path 37, the common recovery flow path 52, and the switching valve 38, and is circulated again.

The recovery sub-tank 18 is an ink tank connected to the first recovery flow path 34 and the second recovery flow path 36, and is arranged lower than the ejection head 12 in the vertical direction. As shown in FIG. 1, in the top surface of the recovery sub-tank 18, a communication port 18*a* for communication with the atmosphere is formed, through which the inside of the recovery sub-tank 18 is placed under an atmospheric-pressure environment. As aforementioned, the first recovery flow path 34 is connected to the ink discharge port 12*b* of the ejection head 12 at one end thereof, and the second recovery flow path 36 is connected to the main tank 14 at one end thereof.

In the recovery sub-tank 18, the ink Q which was not ejected from the ejection head 12 is reserved through the first recovery flow path 34. The ink Q reserved in the recovery sub-tank 18 is returned to the main tank 14 through the second recovery flow path 36.

The ink Q discharged from the ejection head 12 through the ink discharge port 12*b* without being ejected from the ejection head 12 is sent to the recovery sub-tank 18 through the first recovery flow path 34 as a result of a gravity drop due to a pressure head generated by a difference of altitude between the ink liquid surface in the supply sub-tank 16 and the ink liquid surface in the recovery sub-tank 18. The ink Q exceeded the height of the top end of the overflow pipe 18*b* in the recovery sub-tank 18 is returned to the main tank 14 through the second recovery flow path 36, the common recovery flow path 52, and the switching valve 38, and is circulated again.

Also, the ink liquid surface in the recovery sub-tank 18 is kept constant owing to the overflow pipe 18*b*. As a result, a constant pressure which corresponds to the height of the liquid surface in the recovery sub-tank 18 is applied also to ink inflow from the ejection head 12. That is, it is possible to apply a constant static pressure to the discharge port 12*b* of the ejection head 12.

In the recording apparatus 10, in the manner described above, the ink is supplied from the supply sub-tank 16 to the ejection head 12 with a constant pressure head, and a constant pressure is applied also to the ink supply from the ejection head 12 to the recovery sub-tank 18. As a result, it becomes possible to set a pressure applied to the ink inflow port 12*a* and the discharge port 12*b* in the ejection head 12 for ink supply and ink discharge to a completely static pressure, so that a pressure applied to an ink flow path formed in the ejection head 12 becomes constant, which makes it possible to stabilize the meniscuses of the ink Q formed at ejection ports of the ejection head 12 to be described later and the like.

In the recording apparatus 10 according to the present invention, it is also possible to select the height of the meniscuses of the ink Q formed at the ejection ports of the ejection head with a high degree of flexibility by setting the height of at least one of the supply sub-tank 16 and the recovery sub-tank 18 as appropriate. Accordingly, it is preferable that height adjusting means for adjusting the height of at least one of the supply sub-tank 16 and the recovery sub-tank 18 be provided to make it possible to control the state and height of the meniscuses.

It should be noted that the height adjusting means may adopt various methods so long as height adjustment in the vertical direction is possible. Such methods include a method based on a screw axis and a nut that mesh with each other, a method using a cylinder and an actuator, or a method using a cam.

The cleaning liquid tank 22 is a tank for reserving a cleaning liquid for cleaning the ink circulation system and the ejection head, and is connected to one end of each of the cleaning liquid supply flow path 40 and the cleaning liquid recovery flow path 48. The other end of the cleaning liquid supply flow path 40 is connected to the first supply flow path 30 through the switching valve 42. Also, the cleaning liquid circulation pump 56 is provided in the middle of the cleaning liquid supply flow path 40. The switching valve 42 is opened on the cleaning liquid tank 22 side and the cleaning liquid circulation pump 56 is driven to thereby supply the cleaning liquid in the cleaning liquid tank 22 to the supply sub-tank 16.

Next, an operation of the ink circulation system during operation (recording operation) of the recording apparatus 10 will be described. First, the ink is fed by the ink circulation pump 54 from the main tank 14 to the supply sub-tank 16 through the first supply flow path 30 and is reserved in the supply sub-tank 16. Here, the switching valve 42 is closed on the cleaning liquid tank 22 side and is opened the main tank 14 side, so the ink will not flow to the cleaning liquid tank 22 side. The ink Q reserved in the supply sub-tank 16 flows into the ejection head 12 through the second supply flow path 32 and the ink inflow port 12*a* due to a difference in elevation between the supply sub-tank 16 and the ejection head 12. The ink Q which was not ejected from the ejection head 12 is supplied to the recovery sub-tank 18 through the first recovery flow path 34 due to a difference in elevation between the ejection head 12 and the recovery sub-tank 18. Here, by setting the switching valve 38 to open the main tank 14 side and close the cleaning liquid tank 22 side, the ink Q overflowed into the overflow pipe 18*a* in the recovery sub-tank 18 is returned to the main tank 14 through the second recovery flow path 36, the common recovery flow path 52, and the switching valve 38. In this manner, the ink Q is circulated through the main tank 14, the supply sub-tank 16, the ejection head 12, and the recovery sub-tank 18. As described above, the communication ports 16*a* and 18*a* are respectively formed for the supply sub-tank 16 and the recovery sub-tank 18 so that the insides of the sub-tanks are opened to the atmosphere through the communication ports, so the ink Q in the supply sub-tank 16 naturally flows to the recovery sub-tank 18.

It should be noted that the ink Q overflowed into the communication ports 16*a* of the supply sub-tank 16 is returned to the main tank 14 through the third recovery flow path 37, the common recovery flow path 52, and the switching valve 38.

Next, an operation of the recording apparatus 10 at the time of cleaning will be described.

First, the ink circulation pump 54 is stopped, thereby stopping the supply of the ink Q to the supply sub-tank 16. Then, all of the ink is discharged from the inside of the ink circulation system. More specifically, the open/close valve 46 on the drainage flow path 44 connected to the recovery sub-tank 18 is opened, so that the ink reserved in the recovery sub-tank 18 is recovered to the main tank 14 through the drainage flow path 44, the common recovery flow path 52, and the switching valve 38. Also, the ink Q reserved in the supply sub-tank 16 flows into the recovery sub-tank 18 through the ejection head 12, and is then recovered to the main tank 14 through the drainage flow path 44, the common recovery flow path 52, and the switching valve 38 in the same manner as above. In the manner described above, all of the ink in the ink circulation system is recovered to the main tank 14.

Next, the switching valve 38 is switched to close the main tank 14 side and open the cleaning liquid tank 22 side. In addition, the open/close valve 46 is closed. Then, the switching valve 42 provided in a connecting portion between the cleaning liquid supply flow path 40 and the first supply flow path 30 is switched to close the main tank 14 side and open the cleaning liquid tank 22 side so that the cleaning liquid is supplied by the cleaning liquid circulation pump 56 to the supply sub-tank 16. The cleaning liquid supplied to the supply sub-tank 16 flows into the ejection head 12 through the second supply flow path 32 and the inflow port 12*a* at a constant pressure, and is also reserved in the supply sub-tank 16 until the cleaning liquid rises to the height of the top end of the overflow pipe 16*b*. The cleaning liquid which exceeded the height of the top end of the overflow pipe 16*b* and flowed into the overflow pipe 16*b* is recovered to the cleaning liquid tank 22 through the third recovery flow path 37, the common recovery flow path 52, the switching valve 38, and the cleaning liquid recovery flow path 48.

On the other hand, the cleaning liquid flowed into the ejection head 12 through the second supply flow path 32 and the inflow port 12*a* flows through the ink flow path in the ejection head 12, and is then discharged from the ejection head 12 through the discharge port 12*b*. The cleaning liquid discharged from the ejection head 12 through the discharge port 12*b* flows into the recovery sub-tank 18 through the first recovery flow path 34 to be reserved in the recovery sub-tank 18. The cleaning liquid reserved in the recovery sub-tank 18 flows through the overflow pipe 18*b* in the recovery sub-tank 18, the common recovery flow path 52 and the switching valve 38, to be recovered to the cleaning liquid tank 22. By circulating the cleaning liquid in the manner described above, the ink adhering to the ejection head 12 and the ink circulation path 15 is removed.

After the cleaning operation described above is completed, for discharging the cleaning liquid from the inside of the ink circulation system, the cleaning liquid circulation pump 56 is stopped, thereby stopping the supply of the cleaning liquid. Then, unlike in the case of discharging the ink described above, the open/close valve 46 is opened while keeping the switching valve 38 closed on the main tank 14 side and opened on the cleaning liquid tank 22 side. As a result, the cleaning liquid reserved in the supply sub-tank 16 and the recovery sub-tank 18 is discharged to the cleaning liquid tank 22 through the drainage flow path 44, the common recovery flow path 52, the switching valve 38, and the cleaning liquid recovery flow path 48.

By circulating the cleaning liquid in the manner described above, the ejection head and the ink circulation path are cleaned.

Here, as described above, the circulation path is charged through friction between the cleaning liquid and the circulation path at the time of the cleaning operation, which leads to a problem.

The inventors of the present invention have found, as a result of earnest consideration about this problem, that it is possible to prevent the charging depending upon a cleaning liquid used in the cleaning. More specifically, a liquid obtained by adding a charge control agent to an ink dispersion medium is used as the cleaning liquid, to thereby prevent the charging of the circulation path from occurring.

The cleaning liquid used in the recording apparatus according to the present invention will be described.

As described above, a cleaning liquid can be obtained by adding a charge control agent to an ink dispersion medium.

Various dielectric liquids which can be used in ink are exemplified as the ink dispersion medium to be used in the cleaning liquid in the present invention. Preferred examples of the dielectric liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

As the charge control agent used in the present invention, it is possible to use a conventionally known material. For instance, it is possible to use a metallic salt of a fatty acid such as naphthenic acid, octenoic acid, oleic acid, or stearic acid, a metallic salt of a sulfosuccinic acid ester, a metallic salt of an oil-soluble sulfonic acid described in JP 45-556 B, JP 52-37435 A, and JP 52-37049 A, a metallic salt of a phosphoric acid ester described in JP 45-9594 B, a metallic salt of hydrogenated abietic acid or abietic acid described in JP 48-25666 B, alkylbenzene sulfonic acid Ca salts described in JP 55-2620 B, metallic salts of an aromatic carboxylic acid or sulfonic acid described in JP 52-107837 A, JP 52-38937 A, JP 57-90643 A, and JP 57-139753 A, a nonionic surface active agent such as a polyoxyethylated alkylamine, oils and fats such as lecithin and linseed oil, polyvinyl pyrrolidone, an organic acid ester of polyhydric alcohol, a phosphate ester surface active agent described in JP 57-210345 A, a sulfonic acid type resin described in JP 56-24944 B, or the like. Also, it is possible to use an amino acid derivative described JP 60-21056 A and JP 61-50951 A. Further, it is possible to cite a copolymer containing a maleic acid half amide component described in JP 60-173558 A and JP 60-179759 A or the like. Still further, it is possible to cite a quaternized amine polymer described in JP 54-31739 A and JP 56-24944 B. Here, among the materials described above, it is preferable to use the naphthenic acid metallic salt, the dioctylsulfosuccinic acid metallic salt, the copolymer containing a maleic acid half amide component, lecithin, or the amino acid derivative.

Also, it is possible to use two or more kinds of compounds in combination as the charge control agent. Further, the concentration of the charge control agent is preferably set in a range from 0.0001 to 2.0 wt % with respect to the total amount of the solution, and more preferably in a range from 0.001 to 0.1 wt %.

When a liquid obtained by adding a charge control agent to an ink dispersion medium is used as the cleaning liquid at the time of the cleaning of the ink circulation path and the ink jet head in the manner described above, it becomes possible to prevent frictional charging of the circulation path, which stabilizes the electric conductivity of the ink supplied to the circulation path after the cleaning, without causing fluctuation in the electric conductivity. As a result, it becomes possible to eject ink droplets with stability at the time of image recording, which makes it possible to form an image having high image reproducibility. In addition, the charge adjustment agent and the ink dispersion medium used in the ink are used in the cleaning liquid, so it also becomes possible to prevent influences of contamination.

Here, the electric conductivity of the cleaning liquid is preferably set at 1% or more of the electric conductivity of the ink, more preferably 10% or more of the electric conductivity of the ink, further preferably 30% or more of the electric conductivity of the ink, and still further preferably 70% or more of the electric conductivity of the ink. By setting the electric conductivity of the cleaning liquid at 30% or more of the electric conductivity of the ink in this manner, it becomes possible to suitably prevent influences on the electric conductivity of the ink. Also, by further increasing the electric conductivity of the cleaning liquid, it becomes possible to prevent the influences more effectively.

As a preferable form, the recording apparatus 10 includes the ink replenishment portion 23.

The ink replenishment portion 23 replenishes the main tank 14 with a consumed amount of the ink Q and basically includes a concentrated liquid replenishment tank 24, a diluent replenishment tank 26, replenishment flow paths 60 and 64, and replenishment control open/close valves 62 and 66.

The concentrated liquid replenishment tank 24 is an enclosed tank that reserves concentrated ink (high concentration ink, that is, ink whose amount of colorant particles is large) and is connected to the main tank 14 through the flow path for replenishment 60.

On the other hand, the diluent replenishment tank 24 is an enclosed tank that reserves a carrier liquid used as the diluent for the ink at the time of replenishment of the ink Q, and is connected to the main tank 14 through the flow path for replenishment 64.

Here, the open/close valves for replenishment control 62 and 66 are respectively arranged on the flow paths for replenishment 60 and 64, and predetermined amounts of the concentrated ink and the diluent are fed into the main tank 14 by opening/closing the open/close valves for replenishment control 62 and 66 as necessary.

By replenishing the main tank with the concentrated ink and the diluent in the manner described above, it becomes possible to place the main tank under a state in which a predetermined amount of the ink Q having a predetermined concentration is reserved, at all times.

It should be noted that in the present invention, the concentration of the concentrated ink is not specifically limited. Also, ink having the same concentration as an intended concentration of the ink Q may be used as ink for replenishment having a predetermined concentration. Further, the replenishment may be performed using multiple kinds of ink, whose predetermined concentrations are different from each other, as the concentrated ink and the diluent.

In the recording apparatus 10, the timing of the replenishment of the ink Q is not specifically limited. For instance, the ink Q replenishment may be automatically performed each time a predetermined number of images have been drawn or each time a predetermined time has elapsed. Alternatively, the ink Q replenishment may be automatically performed based on a detection result of the amount of the ink Q in the main tank 14. Still alternatively, the ink Q replenishment may be performed corresponding to an instruction inputted by an operator or the like who observed a drawn image. Alternatively, multiple timing determination means may be provided and the ink Q replenishment may be performed selectively.

Also, a method of determining the replenishment amounts of the concentrated ink and the diluent is not specifically limited. For instance, it is sufficient that the replenishment amount of the ink is determined so that the predetermined amount of the ink Q having the predetermined concentration is reserved in the main tank 14 by predicting the consumption amount of the ink Q by using the total number of times of ink ejection found based on image data or the like, a measurement result of the concentration of the circulated ink, the amount of the ink in the main tank 14, or the like in addition to a predicted ink amount to evaporate.

Figure 2:
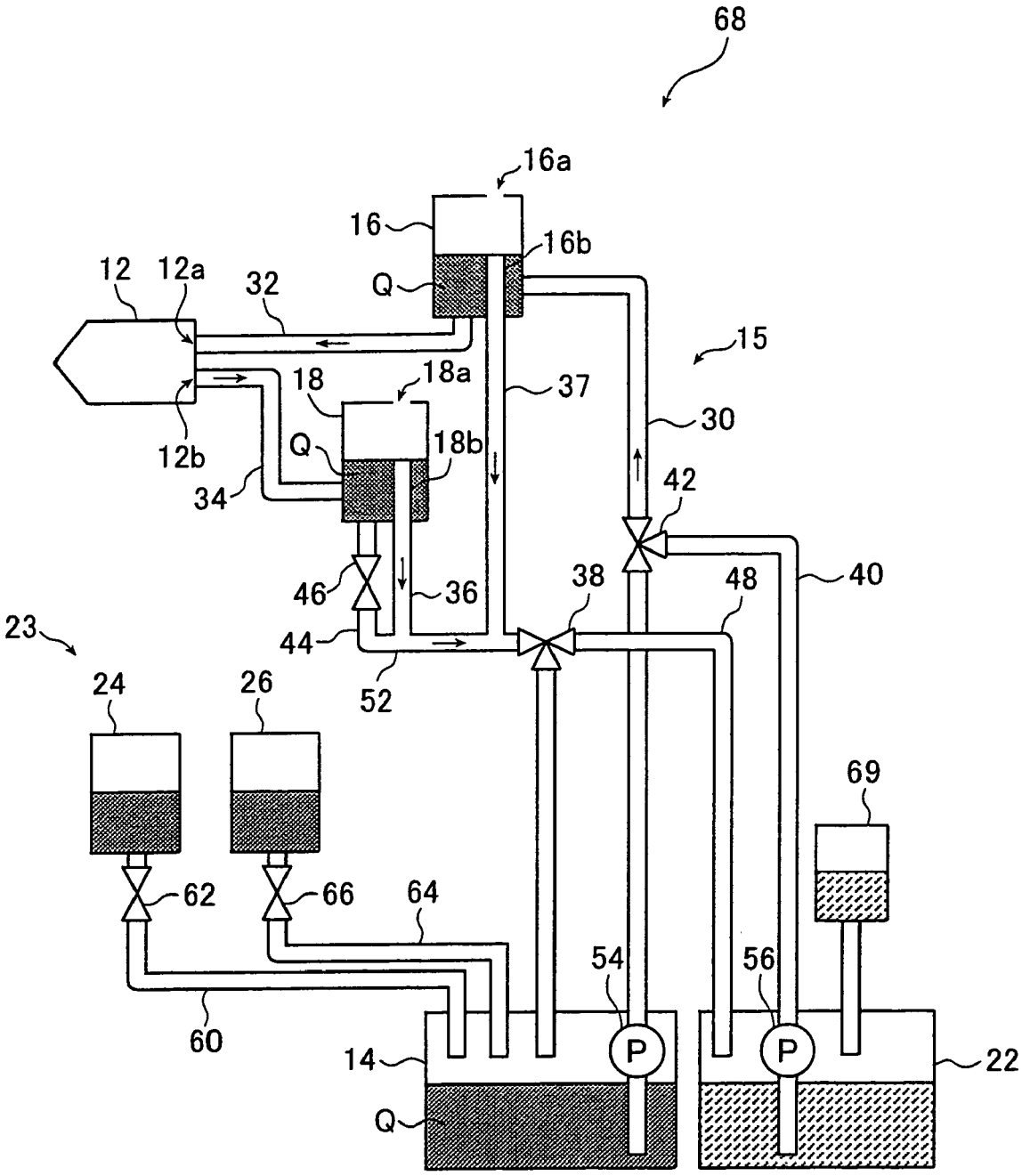
FIG. 2 is a conceptual diagram of another embodiment of a construction of the ink circulation system of the ink jet recording apparatus according to the present invention.

FIG. 2 is a schematic cross-sectional view showing an, outlined construction of another embodiment of the ink jet recording apparatus according to the present invention. Note that an ink jet recording apparatus 68 (hereinafter also simply referred to as the "recording apparatus 68") shown in FIG. 2 has the same construction and shape as the recording apparatus 10 shown in FIG. 1 except that a charge control agent replenishment tank 69 is provided. Therefore, each same member is given the same reference numeral or symbol and the following description will be centered on each different point.

The charge control agent replenishment tank 69 provided in the recording apparatus 68 is connected to the cleaning liquid tank 22, and reserves the charge control agent therein.

The charge control agent replenishment tank 69 replenishes the cleaning liquid tank 22 with a predetermined amount of the charge control agent as necessary so that the cleaning liquid in the cleaning liquid tank 22 assumes a desired electric conductivity.

With the charge control agent replenishment tank described above, it becomes possible to adjust the cleaning liquid to various electric conductivities. That is, even when the electric conductivity of the cleaning liquid has changed, it becomes possible to adjust the cleaning liquid electric conductivity.

Here, the timing of the charge control agent replenishment by the charge control agent replenishment tank 29 is not specifically limited. For instance, the charge control agent replenishment may be automatically performed each time a predetermined number of times of cleaning have been performed. Alternatively, a detector for detecting the electric conductivity of the cleaning liquid in the cleaning liquid tank 22 may be provided and the charge control agent replenishment may be automatically performed based on a value of the electric conductivity detected by the detector. Still alternatively, multiple timing determination means may be provided and the charge control agent replenishment may be performed selectively. Also, a method of determining the replenishment amount of the charge control agent is not specifically limited.

Next, the structure of the ejection head 12 will be explained in detail with reference to FIGS. 3A to 5.

The ejection head 12 is an electrostatic ink jet head in which electrostatic force is caused to act on ink such as the above described one to eject the ink as ink droplets.

In the illustrated embodiment, the ejection head 12 is a so-called line head having a line of ejection portions (so called nozzle line) corresponding to the whole area of a width of a recording medium (size of a recording medium in a direction orthogonal to the scanning/conveying direction). Each of the rows of the ejection portions in the line extends in a row direction (described later) which agrees with the width direction of the recording medium P, and the rows are arranged in the conveying direction of the recording medium (column direction to be described later).

The ink jet recording apparatus in the present invention is not limited to the one in which such line head is used. The ink jet recording apparatus may be one in which a so-called shuttle type head is used, in which the recording medium P is conveyed intermittently and the recording head is scanned in a direction orthogonal to the conveying direction of the recording head in synchronization with this intermittent conveying.

FIGS. 3A and 3B each show a conceptual view of the ejection head 12. Here, FIG. 3A is a partial cross-sectional perspective view and FIG. 3B is a cross-sectional view.

In the recording apparatus 10, while scanning and conveying the recording medium P which has been charged to a negative high voltage (charged to a bias voltage) in a direction orthogonal to an arrangement direction of the ejection portions (row direction to be described later), each ejection portion is driven by modulation in accordance with an image to be recorded, that is, supplied image data to control ejection on/off, whereby ink droplets R are ejected on demand to record an intended image onto the recording medium P.

Figure 4A:
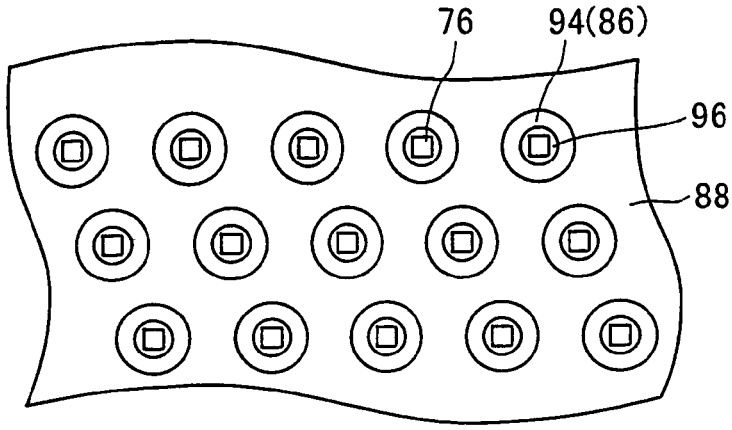
FIG. 4A is a plan view obtained by cutting the ejection head shown in FIG. 3A along a plane containing a guard electrode and parallel to an insulating substrate.
Figure 4B:
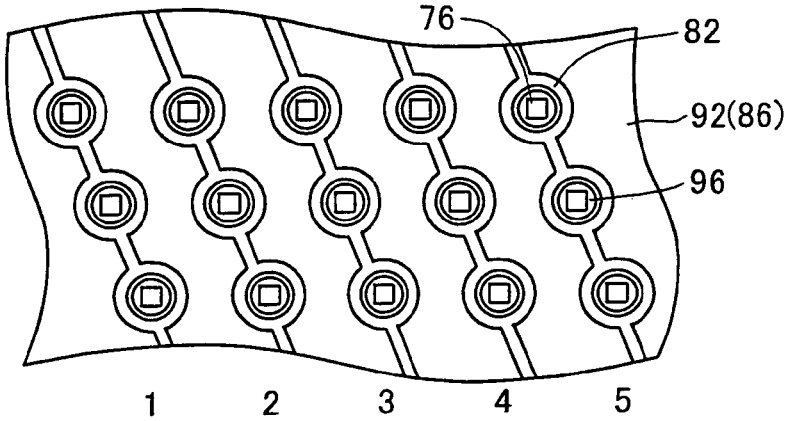
FIG. 4B is a plan view obtained by cutting the ejection head shown in FIG. 3A along a plane containing first control electrodes and parallel to the insulating substrate.
Figure 4C:
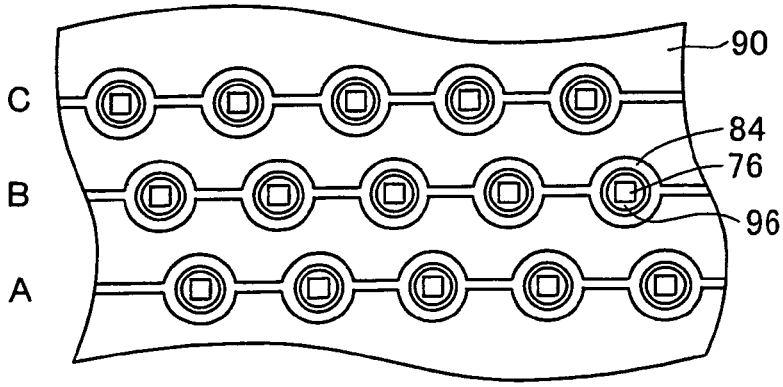
FIG. 4C is a plan view obtained by cutting the ejection head shown in FIG. 3A along a plane containing second control electrodes and parallel to the insulating substrate.

As described above, the ejection head 12 is a line head having a line of the ejection ports corresponding the width of the recording medium P, and as conceptually shown in FIGS. 4A to 4C, the ejection head 12 is an ink jet head having a multi channel structure in which multiple ejection portions are arranged two-dimensionally. However, in FIGS. 3A and 3B, for easy-to-understand illustration of the construction of the ink jet head, only a part of the multiple ejection portions is shown.

The ejection head 12 is an electrostatic ink jet head for allowing electrostatic force to act on the ink Q which is obtained by dispersing colorant particles (charged fine particles which contain a colorant) in a carrier liquid, thereby ejecting ink droplets R. The ejection head 12 includes a head substrate 72, an ejection substrate 74 and ink guides 76.

Furthermore, in the ejection head 12, the head substrate 72 and the ejection substrate 74 are opposed to each other at a predetermined distance, and an ink flow path 78 for supplying the ink Q to each ejection port 96 is formed therebetween. The ink Q is circulated by the ink circulating mechanism in a predetermined path including the ink flow path 78. During recording, the ink Q flows in a predetermined direction, for example in an arrow direction in FIG. 3B, at a predetermined speed (for example, at an ink flow rate of 200 mm/s).

The head substrate 72 is a sheet-shaped insulating substrate common to all the ejection portions, and a floating conductive plate 80 in an electrically floating state is provided on the surface of the head substrate 72.

In the floating conductive plate 80, an induced voltage induced in accordance with a drive voltage to be applied to first control electrodes 82 and second control electrodes 84 (described later) is generated during recording of an image. Furthermore, a voltage value of the induced voltage automatically varies in accordance with the number of operation channels. Owing to the induced voltage, the colorant particles in the ink Q flowing in the ink flow path 78 are urged to migrate to the ejection substrate 74 side. That is, the ink Q in the ejection ports 96 (described later) is concentrated more appropriately.

The floating conductive plate 80 is not an indispensable component but is preferably provided as appropriate. Further, the floating conductive plate 80 need only be disposed on the head substrate 72 side with respect to the ink flow path 78, and for example, may be disposed in the head substrate 72. Furthermore, it is preferable that the floating conductive plate 80 be disposed on an upstream side of the ink flow path 78 with respect to the position where the ejection portions are placed. Furthermore, a predetermined voltage may be applied to the floating conductive plate 80.

On the other hand, the ejection substrate 74 is a sheet-shaped insulating substrate common to all the ejection portions like the head substrate 72. The ejection substrate 74 includes an insulating substrate 86, the first control electrodes 82, the second control electrodes 84, a guard electrode 88 and insulating layers 90, 92 and 94. Furthermore, the ejection ports 96 for the ink are formed in the ejection substrate 74 at positions corresponding to the respective ink guides 76. The ink guide 76 is inserted through each ejection port 96 so as for its tip end portion 98 to project upwardly from the surface of the ejection substrate 74. As described above, the head substrate 72 and the ejection substrate 74 are arranged to be apart from each other, and the ink flow path 78 is formed therebetween.

In the ejection head 12, one ejection portion is formed with the first control electrode 82, the second control electrode 84, the ejection port 96, the ink guide 76 and the like which mutually relates to one another.

Figure 5:
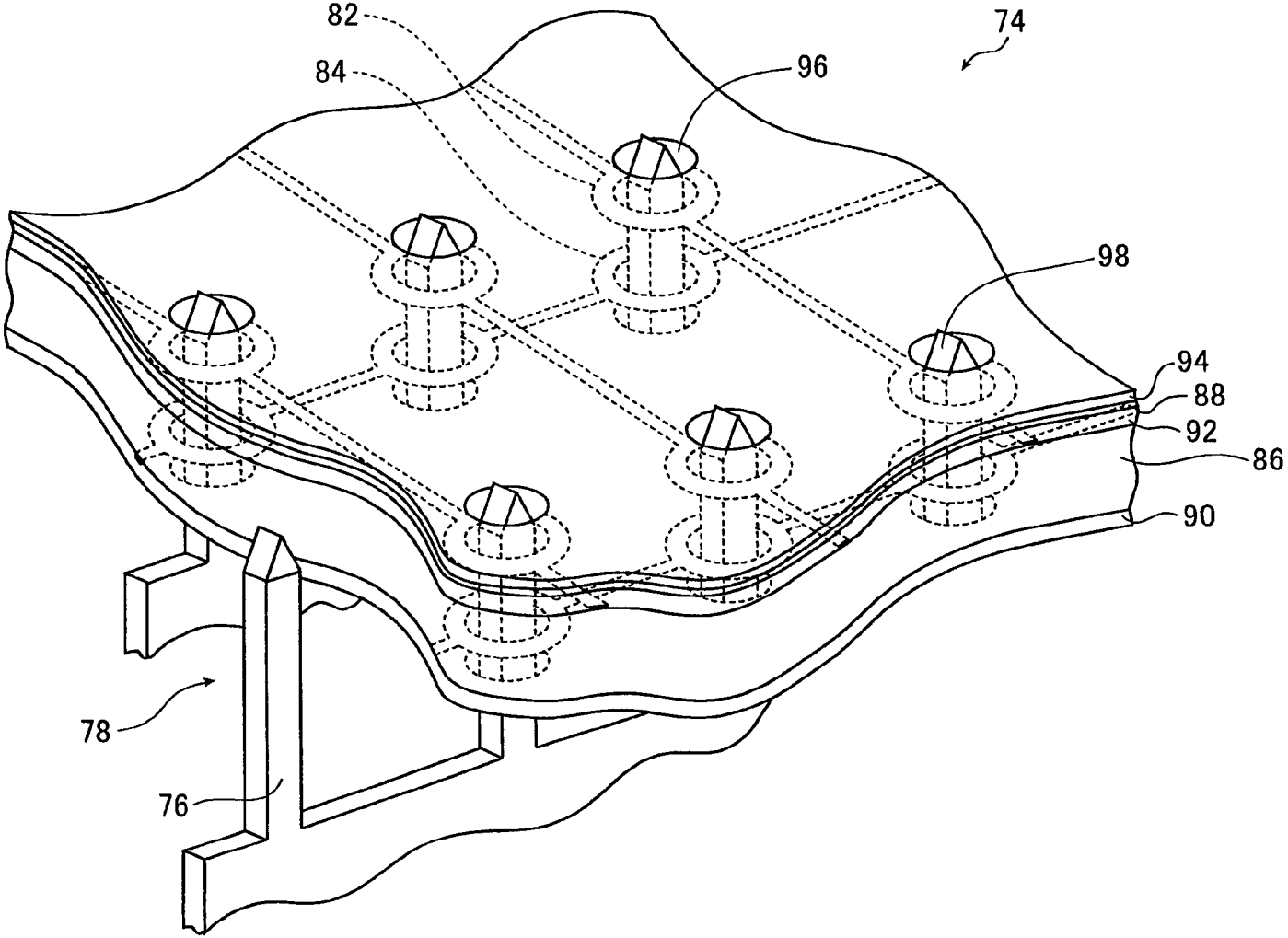
FIG. 5 is an outlined perspective view for explaining the ejection head shown in FIGS. 3A and 3B.

The first control electrodes 82 and the second control electrodes 84 are circular electrodes provided in a ring shape on the upper surface and the lower surface of the insulating substrate 86, respectively, so as to surround the ejection ports 96 corresponding to the respective ejection portions (refer to FIGS. 4A to 5). The upper surfaces of the insulating substrate 86 and the first control electrodes 82 are covered with the insulating layer 92 for protecting and flattening the surfaces, and similarly, the lower surfaces of the insulating substrate 86 and the second control electrodes 84 are covered with the insulating layer 90 for flattening the surfaces. Further, the guard electrode 88 is formed on the insulating layer 92, and the upper surfaces of the guard electrode 88 and the insulating layer 92 are covered with the insulating layer 94 for flattening the surfaces.

The first control electrodes 82 and the second control electrodes 84 are not limited to the circular electrodes in a ring shape. As long as they are disposed so as to face the ink guides 76, electrodes in any shape such as substantially circular electrodes, divided circular electrodes, parallel electrodes, and substantially parallel electrodes can be used.

As shown in FIGS. 4A to 5, in the ejection head 12, the respective ejection portions composed of the ink guides 76, the first control electrodes 82, the second control electrodes 84, the ejection ports 96, and the like are arranged two-dimensionally in a matrix. FIG. 4A is a plan view obtained by cutting the ejection head 12 along a plane containing the guard electrode 88 and parallel to the insulating substrate 86. FIG. 4B is a plan view obtained by cutting the ejection head 12) along a plane containing the first control electrodes 82 and parallel to the insulating substrate 86. FIG. 4C is a plan view obtained by cutting the ejection head 12 along a plane containing the second control electrodes 84 and parallel to the insulating substrate 86;

Specifically, as shown in FIGS. 4B and 4C, the ejection head 12 has three rows (A-row, B-row, C-row) of ejection portions which are arranged in the row direction (transverse direction in FIGS. 4A to 4C). The three rows of ejection head 12 are arranged in a column direction (scanning/conveyance direction (longitudinal direction in FIGS. 4A to 4C)). FIGS. 4A to 4C show that 15 ejection portions are arranged in a matrix state in three rows (A-row, B-row, C-row) in the column direction and five columns (1-column, 2-column, 3-column, 4-column, 5-column) in the row direction.

The ejection head 12 is a line head having lines of ejection portions (nozzle line) corresponding to the whole area of a width of the recording medium in the row direction. Accordingly, in the recording apparatus 10, while the recording medium P is scanned and conveyed in the column direction which is orthogonal to the row direction (arrangement direction of ejection portions (ejection ports 96)=nozzle line direction), an image is recorded on the recording medium P in the electrostatic ink jetting system.

The ejection portions of each row are arranged with predetermined intervals therebetween in the row direction. The ejection portions on a row are disposed so that they are displaced in the row direction from the ejection portions in the adjacent row by ⅓ pitch of the interval. Thus, when viewed in the column direction, each ejection portion in a row is positioned between adjacent ejection portions in the row direction in an adjacent row.

As shown in FIG. 4A, the guard electrode 88 is a sheet-shaped electrode in which regions corresponding to the ejection ports 96 and the control electrodes are opened in a circle. That is, the guard electrode 88 is formed between the control electrodes.

As shown in FIG. 4B, the first control electrodes 82 of the ejection portions disposed in the same column are connected with one another, and as shown in FIG. 4C, the second control electrodes 84 of the ejection portions disposed in the same row are connected with one another.

Further, although it is omitted in FIGS. 4B and 4C, the first control electrodes 82 and the second control electrodes 84 are connected to a pulse power supply which is for applying the drive voltage (pulse voltage) and driving each electrode by modulation to control ejection on/off of the ink droplets R.

During recording of an image, the drive voltage at the same voltage level is applied to the first control electrodes 82 disposed in the same column simultaneously (the first control electrodes 82 are on). Similarly, the drive voltage at the same voltage level is applied to the second control electrodes 84 disposed in the same row simultaneously (the second control electrodes 84 are on).

Furthermore, one row of an image recorded on the recording medium P is divided into three groups in the column direction corresponding to the number of rows of the second control electrodes 84 to be successively recorded in a time division manner by the A-row, the B-row, and the C-row.

For example, in the case shown in FIGS. 4B and 4C, the A-row, the B-row, and the C-row of the second control electrodes 84 are sequentially turned on at a predetermined timing. In synchronization with this, the first control electrodes 82 are driven by modulation (the first control electrodes 82 are turned on/off) in accordance with image data (image to be recorded). Thus, recording is performed three times by the A-row, the B-row, and the C-row in time division manner, whereby one row of an image can be recorded on the recording medium P. As described above, the recording medium P is conveyed in the column direction, so that an image can be recorded at a recording density that is three times as high as a density of each row in the row direction (auxiliary scanning direction).

The control electrodes are not limited to a two-layered electrode structure composed of the first control electrodes 82 and the second control electrodes 84. They may have a single-layered electrode structure or a three or more layered electrode structure.

As mentioned above, the guard electrode 88 is a sheet-shaped electrode common to all the ejection portions. As shown in FIG. 4A, portions in the guard electrode 88 corresponding to the first control electrodes 82 and the second control electrodes 84 formed on the circumferences of the respective ejection portions 96 are opened in a ring shape. That is, the guard electrode 88 is an electrode disposed between the control electrodes. Furthermore, the upper surfaces of the insulating layer 92 and the guard electrode 88 are covered with the insulating layer 94 for protecting and flattening the surfaces.

A predetermined voltage is applied to the guard electrode 88, which plays a role of suppressing the interference of an electric field generated between the ink guides 76 of the adjacent ejection portions.

The guard electrode 88 is not an indispensable component. A shield electrode may be provided in the ejection substrate 74 on the ink flow path 78 side with respect to the second control electrode 84 for blocking a repulsion electric field from the first control electrodes 82 or the second control electrodes 84 in a direction of the ink flow path 78.

The ink guide 76 is a flat plate made of ceramic with a predetermined thickness having a convex tip end portion 98. In the illustrated embodiment, the ink guides 76 of the ejection portions in the same row are arranged at predetermined intervals on the same support placed on the floating conductive plate 80 on the head substrate 72. The ink guides 76 pass through the ejection ports 96 formed in the ejection substrate 74 so that the tip end portions 98 protrude upward from an outermost surface (upper surface of the insulating layer 94 in FIG. 5) on the recording medium P side of the ejection port substrate 98.

The tip end portions 98 of the ink guides 76 are molded in a substantially triangular shape (or a trapezoidal shape) that is tapered gradually toward a not shown holding means of the recording medium P.

It is preferable that a metal be vapor-deposited onto the tip end portions (endmost portions) 98. Although the vapor deposition of the metal onto the tip end portions 98 is not an indispensable element, it substantially increases the dielectric constants of the tip end portions 98, and makes it easy to generate a strong electric field.

There is no particular limit to the shapes of the ink guides 76, as long as the colorant particles in the ink Q are allowed to migrate toward the tip end portions 98 (that is, the ink Q is concentrated). For example, the tip end portions 98 may be varied to an arbitrary shape (e.g., it may not be convex). Furthermore, in order to promote the concentration of ink, slits serving as ink guide grooves for guiding the ink Q to the tip end portions 98 by virtue of a capillary phenomenon may be formed in the central portions of the ink guides 76 in the top-bottom direction on the paper plane of FIG. 3B.

As described above, the second control electrodes 84 are sequentially turned on (driven at a high voltage level (e.g., at 400 to 600 V) or in a high impedance state) row by row at a predetermined timing. All the remaining second control electrodes 84 are turned off (not driven (ground level (ground state))). On the other hand, the first control electrodes 82 are simultaneously turned on/off on a column basis (at a high voltage level or at the ground level) in accordance with image data (image to be recorded). As a result, ejection/non-ejection of the ink (on/off of ink ejection) in each of the ejection portions is controlled.

That is, when the second control electrodes 84 are on, and the first control electrodes 82 are on, the ink Q is ejected in the form of the ink droplet R (ejection on). When the first control electrodes 82 or the second control electrodes 84, or both are off, no ink is ejected (ejection off).

Then, the ink droplets R ejected from the respective ejection portions are attracted to the recording medium P charged to a negative high voltage, and adhere to the recording medium P at predetermined positions to form an image.

As described above, when the rows of the second control electrodes 84 as the lower layer are sequentially turned on, and on/off control for the first control electrodes 82 as the upper layer is performed in accordance with image data, the first control electrodes 82 are turned on in accordance with the image data. Thus, when the individual ejection portions in the column direction are supposed to be the centers, in the ejection portions on both the sides of each central ejection portion in the column direction, the levels of the first control electrodes 82 are changed frequently to the high voltage level or to the ground level. In this case, the guard electrode 88 is biased at a predetermined guard potential, e.g., at the ground level in recording an image, thereby excluding influences of electric fields of the adjacent ejection portions.

In the ejection head 12, whether the on/off control for ink ejection is carried out using one or both of the first control electrodes 82 and the second control electrodes 84 is not a limiting factor at all. That is, the voltages of the control electrode side and the recording medium P side only have to be suitably set so that when a difference between the voltage value on the control electrode side during the on/off control for the ink ejection and the voltage value on the recording medium P side is larger than a predetermined value, the ink is ejected, while when the difference is smaller than the predetermined value, no ink is ejected.

Accordingly, in the ejection head 12, the first and second control electrodes 82 and 84 can also be driven in opposite states. That is, the first control electrodes 82 can be sequentially driven column by column, and the second control electrodes 84 can be driven in accordance with the image data to thereby control on/off of the ink ejection.

In this case, with respect to the column direction, the first control electrodes 82 are turned on column by column, and when the individual ejection portions in the column direction are supposed to be the centers, the first control electrodes 82 of the ejection portions in the columns of both sides of each central ejection portion usually are at the ground level. Thus, the first control electrodes 82 of the ejection portions in the columns of both sides of each central ejection portion function as the guard electrode 88. In the case where the first control electrodes 82 as the upper layer are sequentially turned on column by column, and the second control electrodes 84 as the lower layer are driven in accordance with the image data, even if no guard electrode 88 is provided, the influences of the adjacent ejection portions can be excluded to enhance the recording quality.

While in this embodiment, the colorant particles in the ink Q are positively charged, and the recording medium P side is charged to a negative high voltage, the present invention is not limited thereto. That is, conversely, the colorant particles in the ink may be negatively charged, and the recording medium P side may be charged to a positive high voltage. When the polarity of the colorant particles is thus reversed to that of the colorant particles in the above-mentioned embodiment, the polarities of the voltages applied to the counter electrode, the charging unit for the recording medium P, and the first and second control electrodes 82 and 84 of each of the ejection portions only have to be reversed to those in the above-mentioned embodiment.

In the electrostatic ink jet recording system in which the ink Q containing colorant particles as described above is used, there is not adopted the process in which a force is caused to act on the overall ink to fly the ink towards the recording medium as in a conventional ink jet system, but there is adopted the process in which a force is caused to mainly act on the colorant particles as the solid components dispersed into the carrier liquid to fly the ink droplets. The ejection action of ink droplets R from the ejection head 12 will be described below.

Note that in the following embodiment, the colorant particles are positively charged, and hence when the ink ejection is on, the positive voltages are applied to the corresponding ones of the first control electrodes 82 and the corresponding ones of the second control electrodes 84, respectively, and also the recording medium P is charged to a negative high voltage (bias voltage).

In recording an image, the ink Q is circulated through the ink flow path 78 from the right-hand side to the left-hand side in FIG. 3B (in a direction indicated by arrows in FIG. 3B) at a predetermined speed by the above described circulation mechanism for ink.

As described above, the recording medium P is charged to a negative high voltage, and is scanned and conveyed in a state of opposing the ejection head 12.

Further, as described above, the negative high voltage to which the recording medium P is charged acts as a bias voltage for electrostatic ink jetting, and the recording medium P which is charged to this bias voltage acts as a counter electrode with respect to the control electrodes of the ejection head 12.

When the recording medium P is conveyed to a predetermined position, a drive signal is supplied to the ejection head 12 in accordance with the timing to convey the recording medium P and the image data. Corresponding to this, the second control electrodes 84 in each row are sequentially driven, and the first control electrodes 82 in each column are driven by modulation in accordance with the image data, whereby ink ejection is turned on/off in accordance with the image data.

Here, when the first control electrodes 82 or the second control electrodes 84, or both are off, that is, in a state where only the bias voltage is applied, Coulomb attraction acting between the bias voltage and the colorant particles (charged particles) of the ink Q, Coulomb repulsion among the colorant particles, viscosity, surface tension and dielectric polarization force of the carrier liquid, and the like act on the ink Q, and these forces operate in conjunction with one another to move the colorant particles and the carrier liquid. Thus, the balance is kept in a meniscus shape as conceptually shown in FIG. 3B in which the ink Q slightly rises from the ejection port 96.

The colorant particles move toward the recording medium P charged to the bias voltage through a so-called electrophoresis process by the Coulomb attraction and the like. Therefore, the ink Q is concentrated at the meniscus formed in the ejection port 96.

From this state, the drive voltage (pulse voltage) for ejecting ink droplets R is applied. That is, in the illustrated embodiment, when the first control electrodes 82 and the second control electrodes 84 are both turned on, the drive voltage is superposed on the bias voltage, and the motion occurs in which the previous conjunction motion operates in conjunction with the superposition of the drive voltage. Then, the colorant particles and the carrier liquid are attracted toward the bias voltage side (the counter electrode), i.e., the recording medium P side by the electrostatic force. Thus, the meniscus formed in the ejection port 96 grows upward to form a nearly conical ink liquid column, i.e., the so-called Taylor cone above the ejection port 96. In addition, similarly to the foregoing, the colorant particles are moved to the meniscus surface through the electrophoresis process so that the ink Q at the meniscus is concentrated and has a large number of colorant particles at a nearly uniform high concentration.

When a finite period of time further elapses after the start of the application of the drive voltage, the balance mainly between the force acting on the colorant particles and the surface tension of the carrier liquid is broken at the tip portion of the meniscus having the high electric field strength due to the movement of the colorant particles or the like. As a result, the meniscus abruptly grows to form a slender ink liquid column called the thread having about several μm to several tens of μm in diameter.

When a finite period of time further elapses, the thread grows, and is divided due to the interaction resulting from the growth of the thread, the vibrations generated due to the Rayleigh/Weber instability, the ununiformity in distribution of the colorant particles within the meniscus, the ununiformity in distribution of the electrostatic field applied to the meniscus, and the like. The divided thread is then ejected and flown in the form of the ink droplets R and is attracted by the bias voltage as well to adhere to the recording medium P.

The growth of the thread and its division, and moreover the movement of the colorant particles to the meniscus and/or the thread are continuously generated while the drive voltage is applied. After the end of the application of the drive voltage (the first control electrodes 82 or the second control electrodes 84, or both are off), the meniscus returns to the state shown in FIG. 3B where only the bias voltage is applied to the recording medium P.

One dot of ink is normally formed onto the recording medium P by applying the drive voltage once (one pulse), so that ink droplets R which are divided from the thread and ejected by applying the drive voltage once form one dot.

Here, the ink used in the recording apparatus of the present invention will be described.

The ink Q is obtained by dispersing colorant particles in a carrier liquid. The carrier liquid is preferably a dielectric liquid (non-aqueous solvent) having a high electrical resistivity (equal to or larger than $10^9$ Ω·cm, and more preferably equal to or larger than $10^{10}$ Ω·cm). If the electrical resistance of the carrier liquid is low, the concentration of the colorant particles does not occur since the carrier liquid receives the injection of the electric charges and is charged due to a drive voltage applied to the ejection electrodes. In addition, since there is also anxiety that the carrier liquid having a low electrical resistance causes the electrical conduction between the adjacent control electrodes, the carrier liquid having a low electrical resistance is unsuitable for the present invention.

The relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby the electric field effectively acts on the colorant particles contained in the carrier liquid to facilitate the electrophoresis of the colorant particles.

Note that the upper limit of the specific electrical resistance of the carrier liquid is desirably about $10^{16}$ Ω·cm, and the lower limit of the relative permittivity is desirably about 1.9. The reason why the electrical resistance of the carrier liquid preferably falls within the above-mentioned range is that if the electrical resistance becomes low, then the ejection of the ink under a low electric field becomes worse. Also, the reason why the relative permittivity preferably falls within the above-mentioned range is that if the relative permittivity becomes high, then the electric field is relaxed due to the polarization of the solvent, and as a result the color of dots formed under this condition becomes light, or the bleeding occurs.

Preferred examples of the dielectric liquid used as the carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such colorant particles dispersed in the carrier-liquid, colorants themselves may be dispersed as the colorant particles into the carrier liquid, but dispersion resin particles are preferably contained for enhancement of fixing property. In the case where the dispersion resin particles are contained in the carrier liquid, in general, there is adopted a method in which pigments are covered with the resin material of the dispersion resin particles to obtain particles covered with the resin, or the dispersion resin particles are colored with dyes to obtain the colored particles.

As the colorants, pigments and dyes conventionally used in ink compositions for ink jet recording, (oily) ink compositions for printing, or liquid developers for electrostatic photography may be used.

Pigments used as colorants may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

Further, examples of dispersion resin particles include rosins, rosin-modified phenol resin, alkyd resin, a (meth)acryl polymer, polyurethane, polyester, polyamide, polyethylene, polybutadiene, polystyrene, polyvinyl acetate, acetal-modified polyvinyl alcohol, and polycarbonate.

Of those, from the viewpoint of ease for particle formation, a polymer having a weight average molecular weight in a range of 2,000 to 1,000,000 and a polydispersity (weight average molecular weight/number average molecular weight) in a range of 1.0 to 5.0 is preferred. Moreover, from the viewpoint of ease for the fixation, a polymer in which one of a softening point, a glass transition point, and a melting point is in a range of 40° C. to 120° C. is preferred.

In the ink Q, the content of colorant particles (total content of colorant particles and dispersion resin particles) preferably falls within a range of 0.5 to 30.0 wt % for the overall ink, more preferably falls within a range of 1.5 to 25.0 wt %, and much more preferably falls within a range of 3.0 to 20.0 wt %. If the content of colorant particles decreases, the following problems become easy to arise. The density of the printed image is insufficient, the affinity between the ink Q and the surface of the recording medium P becomes difficult to obtain to prevent the image firmly stuck to the surface of the recording medium P from being obtained, and so forth. On the other hand, if the content of colorant particles increases, problems occur in that the uniform dispersion liquid becomes difficult to obtain, the clogging of the ink Q is easy to occur in the ink jet head or the like to make it difficult to obtain the consistent ink ejection, and so forth.

In addition, the average particle diameter of the colorant particles dispersed in the carrier liquid preferably falls within a range of 0.1 to 5.0 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA Ltd.).

After the colorant particles and optionally a dispersing agent are dispersed in the carrier liquid, a charging control agent is added to the resultant carrier liquid to charge the colorant particles, and the charged colorant particles are dispersed in the resultant liquid to thereby produce the ink Q. Note that in dispersing the colorant particles in the carrier liquid, a dispersion medium may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16(No. 2), p. 44, 1977.

Note that the colorant particles may be positively or negatively charged as long as the charged colorant particles are identical in polarity to the drive voltages applied to ejection electrodes.

In addition, the charging amount of colorant particles is preferably in a range of 5 to 200 μC/g, more preferably in a range of 10 to 150 μC/g, and much more preferably in a range of 15 to 100 μC/g.

In addition, the electrical resistance of the dielectric solvent may be changed by adding the charging control agent in some cases. Thus, the distribution factor P defined below is preferably equal to or larger than 50%, more preferably equal to or larger than 60%, and much more preferably equal to or larger than 70%.

$$P=100\times(\sigma 1-\sigma 2)/\sigma 1$$

where σ1 is an electric conductivity of the ink Q, and σ2 is an electric conductivity of a supernatant liquid which is obtained by inspecting the ink Q with a centrifugal separator. Those electric conductivities were measured by using an LCR meter (AG-4311 manufactured by ANDO ELECTRIC CO., LTD.) and electrode for liquid (LP-05 manufactured by KAWAGUCHI ELECTRIC WORKS, CO., LTD.) under a condition of an applied voltage of 5 V and a frequency of 1 kHz. In addition, the centrifugation was carried out for 30 minutes under a condition of a rotational speed of 14,500 rpm and a temperature of 23° C. using a miniature high speed cooling centrifugal machine (SRX-201 manufactured by TOMY SEIKO CO., LTD.).

The ink Q as described above is used, which results in that the colorant particles are likely to migrate and hence the colorant particles are easily concentrated.

The electric conductivity of the ink Q is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the control electrodes are not excessively high, and also there is no anxiety to cause the electrical conduction between the adjacent control electrodes.

In addition, the surface tension of the ink Q is preferably in a range of 15 to 50 mN/m, more preferably in a range of 15.5 to 45.0 mN/m, and much more preferably in a range of 16 to 40 mN/m. The surface tension is set in this range, resulting in that the applied voltages to the control electrodes are not excessively high, and also the ink does not leak or spread to the periphery of the head to contaminate the head.

Moreover, the viscosity of the ink Q is preferably in a range of 0.5 to 5.0 mPa·sec, more preferably in a range of 0.6 to 3.0 mPa·sec, and much more preferably in a range of 0.7 to 2.0 mPa·sec.

The ink Q can be prepared for example by dispersing colorant particles into a carrier liquid to form particles and adding a charging control agent to the dispersion medium to allow the colorant particles to be charged. The following methods are given as the specific methods.

(1) A method including: previously mixing (kneading) a colorant and optionally dispersion resin particles; dispersing the resultant mixture into a carrier liquid using a dispersing agent when necessary; and adding the charging control agent thereto.

(2) A method including: adding a colorant and optionally dispersion resin particles and a dispersing agent into a carrier liquid at the same time for dispersion; and adding the charging control agent thereto.

(3) A method including adding a colorant and the charging control agent and optionally the dispersion resin particles and the dispersing agent into a carrier liquid at the same time for dispersion.

The ink jet recording apparatus according to the present invention has been described in detail above, however, the present invention is not limited to the above embodiments and it is of course possible to make various modifications and changes without departing from the gist of the present invention.

For instance, in the above embodiments, the ink jet recording apparatus of the present invention is used in an electrostatic concentrated ink jet recording apparatus in which the ink obtained by dispersing colorant particles (charged particles which contain colorants) in a carrier liquid is used, however, the present invention is not limited thereto. The ink jet recording apparatus of the present invention is also suitably applied to an electrostatic non-concentrated ink jet recording apparatus.

The ejection head of the recording apparatus in the present invention is not limited to a static-pressure type ejection head. For instance, it may be a pump-type ejection head in which ink is directly supplied to an ink reservoir provided in an ejection head by pump or the like.

Hereinafter, the present invention will be described in more detail based on specific examples of the present invention.

EXAMPLES

In the examples, the recording apparatus 10 shown in FIG. 1 was used, and different kinds of cleaning liquids were used for cleaning. The charge amount of the circulation path after the cleaning was measured in each case. Here, fluoro rubber tubes were used as the piping of the circulation path of the recording apparatus 10.

Example 1

In this example, a liquid obtained by using Isopar G (manufactured by Exxon Corp.) as the ink dispersion medium and adding 0.05 wt % of an octadecene-half maleic acid octadecylamide copolymer as the charge control agent to set the electric conductivity at 800 pS/cm that is the same as the electric conductivity of the ink was used as the cleaning liquid.

Here, the charge amount of the circulation path was measured in the manner described below.

The cleaning liquid was circulated based on the cleaning operation described above, and the surface potentials of the second supply flow path 32 and the first recovery flow path 34 were measured using an electrostatic voltmeter "MODEL 344" manufactured by TREK, INC.

In the manner described above, the charge amount of the circulation path was measured. It was found as a result of the measurement that the charge amount (surface potential of the tube) of the circulation path was around 0 V. In addition, image recording was performed by circulating the ink again after the cleaning, and it was found that formation of an image having high reproducibility was realized.

Example 2

In this example, a liquid obtained by adding 0.04 wt % of an octadecene-half maleic acid octadecylamide copolymer as the charge control agent to set the electric conductivity of the solution at 70% (56 pS/cm) of the electric conductivity of the ink was used as the cleaning liquid.

The circulation path was cleaned using the cleaning liquid in the same manner as above and the charge amount after the cleaning was measured. It was found as a result of the measurement that the charge amount of the circulation path was approximately 0 V. In addition, image recording was performed by circulating the ink again after the cleaning, and it was found that formation of an image having high reproducibility was realized.

Example 3

In this example, a liquid obtained by adding 0.01 wt % of an octadecene-half maleic acid octadecylamide copolymer as the charge control agent to set the electric conductivity of the solution at 30% (240 pS/cm) of the electric conductivity of the ink was used as the cleaning liquid.

The circulation path was cleaned using the cleaning liquid in the same manner as above and the charge amount after the cleaning was measured. It was found as a result of the measurement that the charge amount of the circulation path was 300 to 800 V. In addition, image recording was performed by circulating the ink again after the cleaning, and it was found that reproducibility was slightly lowered from the reproducibility in Examples 1 and 2 described above but was at a sufficiently practicable level.

Comparative Example 1

In this comparative example, a solution, in which no charge control agent was added to the ink dispersion medium, was used as the cleaning liquid. Here, the electric conductivity of the solution was 0 pS/cm and measurement was impossible.

The circulation path was cleaned using the cleaning liquid in the same manner as above and the charge amount after the cleaning was measured. It was found as a result of the measurement that the charge amount of the circulation path was 500 V to 1 kV. In addition, image recording was performed by circulating the ink again after the cleaning, and it was found that ink ejection was not stabilized and reproducibility was lowered from the reproducibility in Examples 1 and 2 described above.

The charge control agent concentration of the cleaning liquid, the electric conductivity of the cleaning liquid, the measurement results of the charge amount, and the image reproducibility described above are collectively shown in Table 1 given below.

TABLE 1

| | Charge control agent concentration | Electric conductivity | Charge amount | Image reproducibility |
|---|---|---|---|---|
| Example 1 | 0.05 wt % | 800 pS/cm | 0 V | A |
| Example 2 | 0.04 wt % | 560 pS/cm | 0 V | A |
| Example 3 | 0.01 wt % | 240 pS/cm | 300-800 V | B |
| Comparative Example 1 | 0 wt % | 0 pS/cm | 500 V-1 kV | C |

As shown in Table 1, according to the present invention in which a solution obtained by adding a charge control agent to an ink dispersion medium is used as the cleaning liquid, it becomes possible to prevent the circulation path and the ejection head from being charged at the time of cleaning. As a result, in the ink jet recording in which the ink droplets are ejected by means of electrostatic forces, even when the ink is circulated after the cleaning, it becomes possible to control the charge amount of the ink with stability, which makes it possible to form an image having high image reproducibility.

Effects of the present invention are apparent from the results described above.

What is claimed is:

1. An ink jet recording system including an ink let recording apparatus and its ink, comprising:

ink containing charged colorant particles;

a cleaning liquid including an ink dispersion medium and a charge control agent; and an ink jet recording apparatus for ejecting ink droplets toward a recording medium by exerting electrostatic force onto the ink containing the charged colorant particles, comprising:

an ejection head for ejecting the ink droplets by exerting the electrostatic force onto the ink containing the charged colorant particles;

an ink tank for reserving the ink to be supplied to the ejection head;

a circulation path for circulating the ink between the ejection head and the ink tank; and a cleaning mechanism for cleaning the ejection head and the circulation path using the cleaning liquid.

2. The ink jet recording system according to claim 1, wherein electric conductivity of the cleaning liquid is 30% or more of electric conductivity of the ink.

3. The ink jet recording system according to claim 2, wherein the electric conductivity of the cleaning liquid is 70% or more of the electric conductivity of the ink.

4. An ink jet recording system including an ink jet recording apparatus and its ink, comprising:

ink containing charged colorant particles;

a cleaning liquid including an ink dispersion medium and a charge control agent; and an ink jet recording apparatus for ejecting ink droplets toward a recording medium by exerting electrostatic force onto the ink containing the charged colorant particles, comprising:

an ejection head for ejecting the ink droplets by exerting the electrostatic force onto the ink containing the charged colorant particles;

an ink tank for reserving the ink to be supplied to the ejection head;

a circulation path for circulating the ink between the ejection head and the ink tank; and a cleaning mechanism for cleaning the ejection head and the circulation path using the cleaning liquid, wherein the cleaning mechanism comprises:

a cleaning liquid tank for reserving the cleaning liquid; and a charge control agent tank connected to the cleaning liquid tank for supplying the charge control agent to the cleaning liquid tank.

5. The ink jet recording system according to claim 4, wherein electric conductivity of the cleaning liquid is 30% or more of electric conductivity of the ink.

6. The ink jet recording system according to claim 5, wherein the electric conductivity of the cleaning liquid is 70% or more of the electric conductivity of the ink.

* * * * *